US005933894A

United States Patent [19]

Bates

[11] Patent Number: 5,933,894

[45] Date of Patent: Aug. 10, 1999

[54] COMBINATION TOOL WITH NAIL STARTER

[76] Inventor: Jeffrey S. Bates, 41 Trout Cir., Freeport, Fla. 32439

[21] Appl. No.: 09/065,494

[22] Filed: Apr. 24, 1998

[51] Int. Cl.[6] ..... B25F 1/00; B25C 3/00

[52] U.S. Cl. ..... 7/164; 7/169; 7/170; 81/44

[58] Field of Search ..... 7/164, 169, 170; 81/44

[56] References Cited

U.S. PATENT DOCUMENTS

| | | | |
|---|---|---|---|
| 147,113 | 2/1874 | Ellsworth . | |
| 363,331 | 5/1887 | Hammer | 7/138 |
| 383,516 | 5/1888 | De Puy . | |
| 1,840,135 | 1/1932 | Schutt | 7/164 |
| 3,338,279 | 8/1967 | Kruttschnitt | 81/44 |
| 3,682,213 | 8/1972 | Litz | 81/44 |
| 4,079,764 | 3/1978 | Hayes | 81/44 |
| 4,422,489 | 12/1983 | Ross . | |
| 4,631,985 | 12/1986 | Roberts . | |
| 4,691,598 | 9/1987 | Lin | 81/44 |
| 4,784,025 | 11/1988 | Peck . | |
| 4,843,923 | 7/1989 | Voss . | |
| 5,284,070 | 2/1994 | Rieck | 81/44 |
| 5,321,996 | 6/1994 | Wei . | |
| 5,464,421 | 11/1995 | Wortrich . | |

FOREIGN PATENT DOCUMENTS 585964 11/1958 Italy .

OTHER PUBLICATIONS

Foreign Patent Document dated Apr. 1958 No. 566451 discovered during prior art search; no further information available.

*Primary Examiner*—David A. Scherbel
*Assistant Examiner*—Philip J. Hoffmann
*Attorney, Agent, or Firm*—Birch, Stewart, Kolasch & Burch, LLP

[57] ABSTRACT

A combination tool includes many useful features for a carpenter. A nail-starting head of the tool includes differently sized nail starting, through holes. In operation, a nail is inserted into one of the through holes and frictional engaged thereby. The carpenter starts the nail into a piece of building material, and then pulls on a handle of the tool to free the tool from the nail. The nail is then driven into the building material. The tool also includes a graduated straight edge along the handle and a T-square formed between the handle and the head. The handle is approximately sixteen inches long and the graduation markings assist the carpenter in finding a next adjacent wallboard stud, once a first wallboard stud is located.

20 Claims, 2 Drawing Sheets

COMBINATION TOOL WITH NAIL STARTER

BACKGROUND OF THE INVENTION

1. Field of the Invention

The present invention relates to a combination tool useful in carpentry work. In particular, the present invention is a combination tool that incorporates a nail-starting tool for various gauges of nails, a carpenter's square, a straight edge, and a measuring stick.

2. Description of the Relevant Art

Various nail-starting tools are known in the carpentry art. For example, U.S. Pat. No. 4,079,764 illustrates a nail-starting tool, useful in starting equally spaced, identical nails along an upholstery seam. U.S. Pat. Nos. 383,516, 4,422,489, 4,631,985, and 4,784,025 illustrate nail-holding tools having a single grasping mechanism for holding a nail, so that a hammer may be used to manually start a nail. U.S. Pat. No. 5,321,996 shows a folding, pocket tool having a plurality of differently sized nail grasping mechanisms. U.S. Pat. No. 3,682,213 shows a nail starting tool having a plurality of spaced, nail grasping mechanisms, so that nails can be even spaced to produce a uniform appearance. Further, various combination tools are known in the existing arts. For example, U.S. Pat. No. 147,113 illustrates a combination wrench, rule, screwdriver, hammer, box opener, and nail drawer.

SUMMARY OF THE INVENTION

The present invention provides a combination tool, which includes the benefits of a nail-starting tool in combination with other tools useful to a carpenter. The present tool is not an aggregation of unrelated tools, rather in certain instances the various tools cooperate in achieving a single function, as will be explained in detail in the specification, which follows.

It is a primary object of the present invention to provide a combination tool, which incorporates a plurality of carpentry tools in a single compact instrument.

It is another object of the present invention to provide a nail-starting tool, which allows nails to be started at locations normally requiring the use of a ladder.

It is another object of the present invention to provide a combination tool, which easily aligns nails with a next adjacent wall stud, when wallboard is being installed.

These and other objects are fulfilled by providing a combination tool comprising: an elongate handle having a first edge and a first end and a second end; a head attached to said second end of said elongate handle, said head having a second edge and a third edge, said second edge abutting said first edge and forming a ninety degree angle with said first edge; a first through hole form in said head; and a first through channel communicating said first through hole to said third edge of said head.

These and other objects are also fulfilled by providing a combination tool comprising: an elongate handle having a first edge and a first end and a second end, said first edge being straight, lying in a first plane, and including measurement markings; a head attached to said second end of said elongate handle, said head having a second edge and a third edge, said second edge abutting said first edge; a first through hole form in said head; and a first through channel communicating said first through hole to said third edge of said head Further, these and other objects are fulfilled by providing a combination tool comprising: an elongate handle having a first edge and a first end and a second end, said first edge being straight, said elongate handle being planar and lying in a first plane; a head fixedly attached to said second end of said elongate handle, said head having a second edge and a third edge, said second edge abutting said first edge, said head being planar and lying in said first plane; a first through hole form in said head; and a first through channel communicating said first through hole to said third edge of said head.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus, are not limitative of the present invention, and wherein.

DETAILED DESCRIPTION OF THE INVENTION

Figure 1:
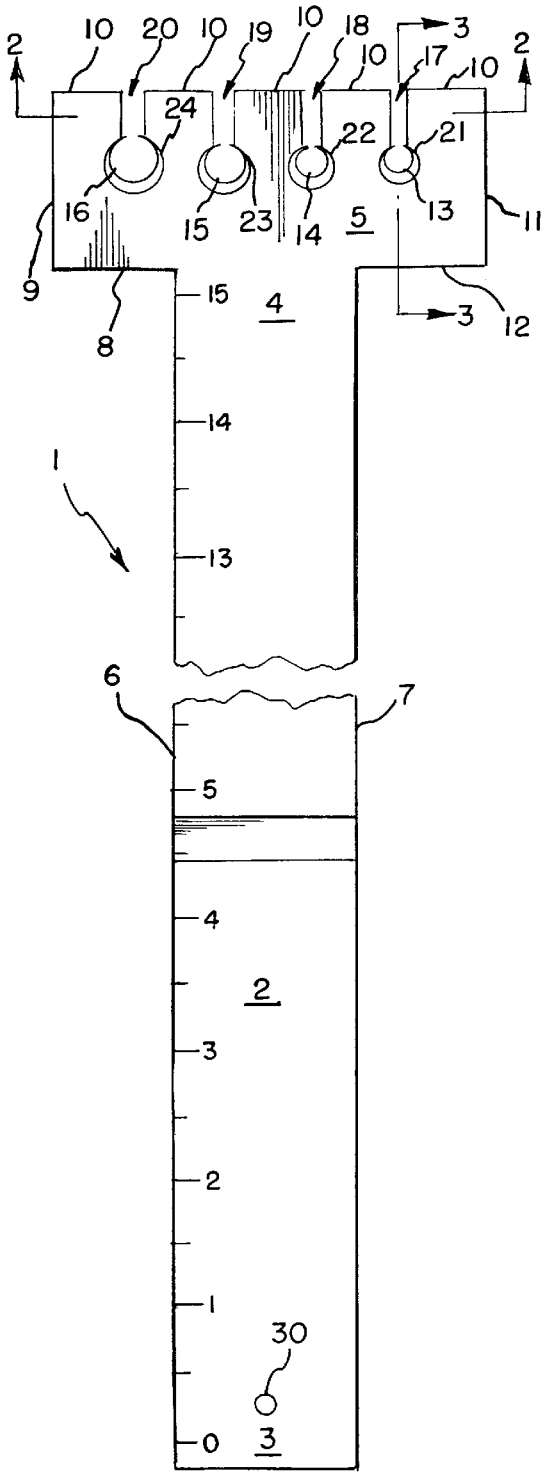
FIG. 1 is an overhead view of a combination tool in accordance with the present invention.
Figure 4:
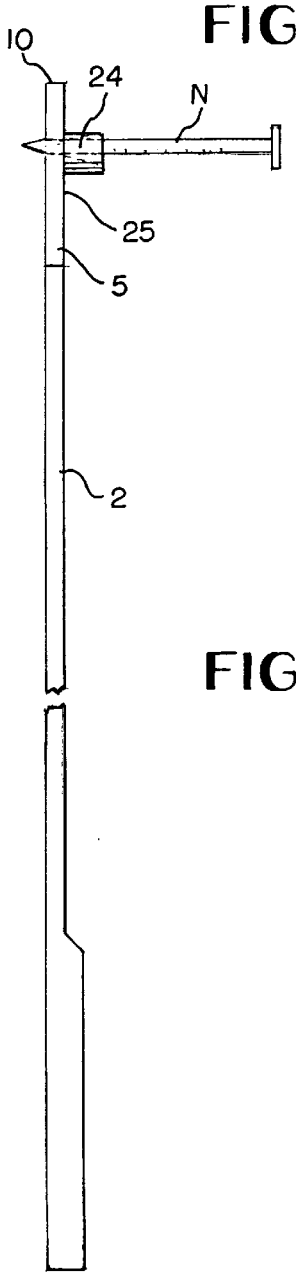
FIG. 4 is a left side view of the combination tool of FIG. 1.

As shown in FIG. 1, the combination tool 1 includes an elongate handle 2 having a first end 3 and a second end 4. The first end 3 includes a lanyard hole 30. A leather strap, or rope, can be tied through the lanyard hole 30, thereby allowing the combination tool 1 to be hung from a nail or peg on a workshop wall for easy storage. The first end 3 is preferably twice the thickness of the second end 4, as can be seen in FIG. 4. The increased thickness of the first end 3 improves the ergonomic feel of the combination tool during use.

A head 5 is attached to the second end 4 of the elongate handle 2. The head 5 may be a separate member attached to the handle 2 by fixing devices, such as screws, rivets, or welds, however in a preferred embodiment, the head 5 and handle 2 are integrally formed. The head 5 and handle 2 are constructed of a semi-rigid to rigid material. Material such as plastic, wood or metal would be suitable.

The handle 2 includes a first edge 6 and a second edge 7. The first edge 6 is straight and includes graduation markings. The graduation markings are illustrated as inches, however metric markings, or other measuring types of indications could be placed along the first edge as an alternative to, or in combination with, the inch markings. The second edge 7 is also illustrated as being straight, however the second edge 7 may include finger notches or indentations to improve the ergonomic feel of the combination tool 1.

The head 5, located at the second end of the handle 2, has a generally rectangular outer configuration. A first side-edge 8 of the head 5 adjoins the first edge 6 of the handle 2 and forms a ninety-degree angle therewith. A second side-edge 9 of the head 5 adjoins the first side-edge 8 and forms approximately a ninety-degree angle therewith. A third side-edge 10 of the head 5 adjoins the second side-edge 9 and forms approximately a ninety-degree angle therewith. A fourth side-edge 11 of the head 5 adjoins the third side-edge 10 and forms approximately a ninety-degree angle therewith. A fifth side-edge 12 of the head 5 adjoins the fourth side-edge 11 and forms approximately a ninety-degree angle therewith. The fifth side-edge 12 also adjoins the second edge 7 of the handle 2 and forms approximately a ninety-degree angle therewith.

Four through holes 13, 14, 15, 16 are provided in the head 5. A first through hole 13 has a first diameter. A second through hole 14 has a second diameter. A third through hole 15 has a third diameter. A fourth through hole 16 has a fourth diameter. The fourth diameter is greater than the third diameter, which is greater than the second diameter, which is greater than the first diameter. Although four through holes 13, 14, 15, 16 are illustrated, it should be clear that more or less through holes could be provided in the head 5.

The head 5 also includes four through channels 17, 18, 19, 20. A first through channel 17 connects the first through hole 13 to the third side-edge 10. A second through channel 18 connects the second through hole 14 to the third side-edge 10. A third through channel 19 connects the third through hole 15 to the third side-edge 10. A fourth through channel 20 connects the fourth through hole 16 to the third side-edge 10. The fourth through channel 20 is wider than the third through channel 19, which is wider than the second through channel 18, which is wider than the first through channel 17. Of course, the through channels correspond in number to the through holes. If more or less through holes were provided in the head 5, more or less though channels would be included in the head 5.

Each through hole, and associated through channel, is sized for starting a specific size nail N, respectively. For example, through hole 13 and through channel 17 are sized to start an eighteen-penny nail, through hole 14 and through channel 18 are sized to start a sixteen-penny nail; through hole 15 and though channel 19 are sized to start a twelve-penny nail; and through hole 16 and through channel 20 are sized to start a ten-penny nail. Of course, the though holes and through channels may be sized to start other sizes of nails in various combinations.

Figure 2:
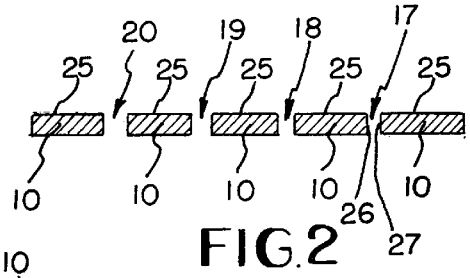
FIG. 2 is a cross sectional view taken along line 2—2 of FIG. 1.

As illustrated in FIG. 2, the first through channel 17 is formed between sidewalls 26 and 27. Sidewall 26 is spaced from sidewall 27 a distance slightly greater than a diameter of an eighteen-penny nail. In a similar fashion, through channels 18, 19, 20 are also formed between sidewalls, which are spaced apart a distance slightly greater than the diameter of a sixteen penny nail, a twelve penny nail, and a ten penny nail, respectively.

Each of the through holes 13, 14, 15, 16 is partially surrounded by a collar 21, 22, 23, 24. A first collar 21 partially surrounds the first though hole 13, and extends away from an outer surface 25 of the head 5. A second collar 22 partially surrounds the second though hole 14, and extends away from the outer surface 25. A third collar 23 partially surrounds the third though hole 15, and extends away from the outer surface 25. A fourth collar 24 partially surrounds the fourth though hole 16, and extends away from the outer surface 25.

Figure 3:
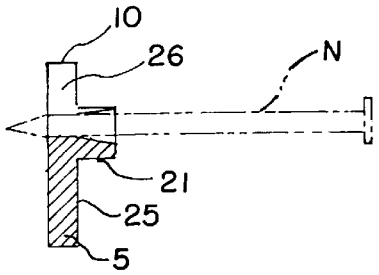
FIG. 3 is a cross sectional view taken along line 3—3 of FIG. 1, including a nail illustrated using a dot-chain line.

As illustrated in FIG. 3, the collars are thickest on their lower sides, facing away from the third side-edge 10 of the head 5. Each side of the collar becomes progressively thinner as it approaches the upper side of the collar, facing toward the third side-edge 10 of the head 5. Each side of the collar eventually converges to a thin line, which is slightly protruded into the through channel.

Now, the operation and characteristics of the combination tool 1 will be described. It is envisioned that a carpenter would carry the combination tool 1 at the work site. Because of the combination tool's slim profile, the combination tool 1 could be inserted behind, or in front of, a hammer within a hammer-carrying loop on the carpenter's belt. Alternatively, the combination tool 1 may be carried in a common toolbox, or inside a special carrying case.

At the work site, the straight edge 6 of the handle 2 can be used to mark building materials for cutting or alignment. Also, the graduation markings on the first edge 6 can be used to measure distances. The right angle formed between the first edge 6 of the handle 2 and the first side-edge 8 of the head 5 makes a handy and quickly accessible T-square. A T-square is, of course, indispensable on a job site for aligning building materials and for marking and measuring building materials.

The primary utility of the combination tool 1 resides in its ability to hold a nail N, so that a hammer can start the nail. In operation, the carpenter selects an appropriately sized nail. Based upon the size of the nail, one of the variously sized through holes 13, 14, 15, 16 of the head 5 is selected. For example, if the nail were an eighteen-penny nail, through hole 13 would be selected. If the nail were a sixteen-penny nail through hole 14 would be selected.

Figure 5:
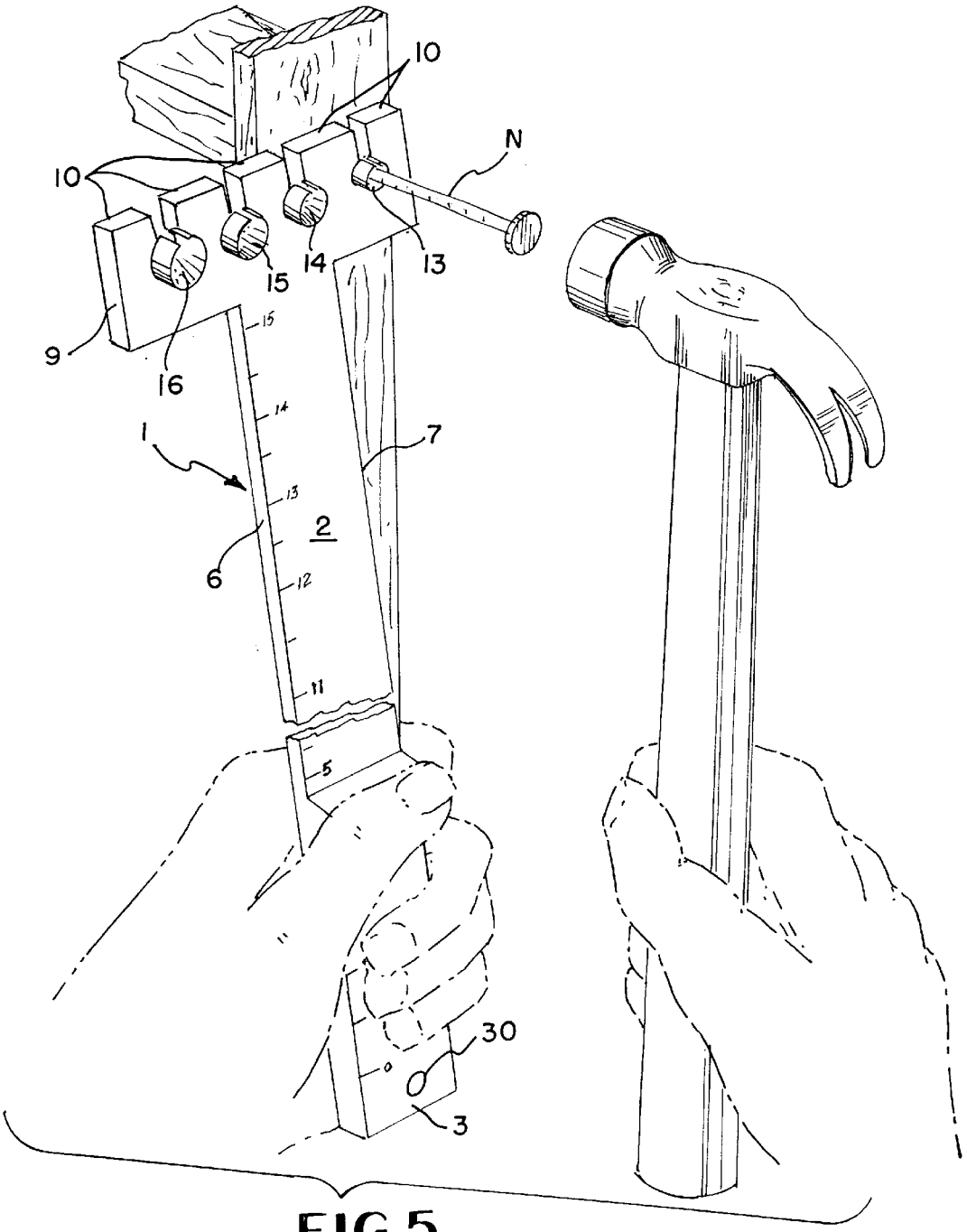
FIG. 5 is a perspective view of a carpenter using the combination tool.

As illustrated in FIGS. 3, 4 and 5, the nail N is manually pushed into the selected through hole so that a starting, pointed end of the nail slightly protrudes from a back surface of the head 5. The diameter of the selected through hole is approximately the same as, or slightly smaller than, the diameter of the nail, thereby the nail is frictional retained by the inner perimeter of the through hole. This frictional engagement prevents the nail from falling out of the through hole while the combination tool 1 is moved to the desired location to be nailed, yet allows the nail to be further inserted into the hole, or removed from the hole, if a sufficiently strong force is applied to the nail.

The carpenter grasps the handle 2 and aligns the starting, pointed end of the nail to the desired location to be nailed. The carpenter uses a hammer to strike the flattened, driving end of the nail. The nail is partially driven into the building material. Once the nail is partially driven, the carpenter pulls the handle 2 of the combination tool 1 in a direction transverse to an extension direction of the nail. The pulling of the handle 2 causes the shaft portion of the nail to snap past the thin line edges of the collar. Once the nail has snapped past the thin line edges of the collar, the nail freely passes into the through channel associated with the through hole. The width of the through channel is slightly greater than the diameter of the nail, therefore the combination tool can be easily and completely removed from the nail. With the combination tool completely removed from the nail, the carpenter finishes hammering the nail into the building material.

By using the combination tool 1 during the initial hammering of the nail, the carpenter reduces the risk of injuring his fingers with the hammer. Further, because the handle 2 of the combination tool 1 is extended in length, the carpenter can hammer nails into an overhead area, which would, without the use of the combination tool 1, require the use of a ladder.

The combination tool also enables individuals lacking a hand, or complete physical use of a hand, to hammer nails into building materials. The handicapped individual could load a nail into one of the through holes and use their elbow, or any other body part, to steady the combination tool against the building material. Then, using their other functioning hand, the handicapped individual could hammer the nail into the building material.

A particularly advantageous feature of the combination tool 1 is the dimensioning of the handle 2 in relation to the through holes 13, 14, 15, 16. From the "0" graduation mark, the transverse linear distance to the center of each through hole is sixteen inches. Wallboard stubs, in convention housing, are placed sixteen inches apart. Therefore, once a wallboard stub is located, the next adjacent wallboard stub can be easily and quickly nailed into by loading a through hole with a nail, aligning the "0" graduation marking with the known wallboard stub, and holding the combination tool perpendicular to the ground surface. The loaded nail will be aligned with the next adjacent wallboard stub, so that the carpenter can simply start hammering on the loaded nail.

To assist in holding the combination tool 1 perpendicular to the ground, a bubble-type level, electrical level, or any other known type of level, may be included within the handle 2. Thereby, the carpenter can be assured that the loaded nail is horizontally spaced sixteen inches away from the known wallboard stud. The level would also offer additional diverse advantages to the combination tool, similar to the advantages mention in relation to the straight edge and T-square.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A combination tool comprising:

an elongate handle having a first end and a second end;

a head attached to said second end of said elongate handle, said head having a first flat surface for overlaying a work surface and a second surface opposite said first surface;

a first through hole form in said head;

a first through channel communicating said first through hole to an edge of said head; and a first collar partially surrounding said first through hole and extending away from said second surface of said head to assist in holding a nail in said first through hole.

2. The combination tool according to claim 1, wherein said first collar has a first thickness, and wherein said first collar has second thicknesses, which are each less than said first thickness, adjacent perimeter portions of said first through hole adjacent said first through channel.

3. The combination tool according to claim 1, wherein a distance from said first end of said elongate handle to said first through hole of said head is approximately sixteen inches.

4. The combination tool according to claim 1, wherein said elongate handle and said head are constructed of a plastic material and are integrally formed.

5. The combination tool according to claim 1, wherein said elongate handle has a first edge, said head has a second edge and a third edge, said second edge abuts said first edge and forms a ninety degree angle with said first edge, and said first through channel communicates said first through hole to said third edge of said head.

6. The combination tool according to claim 5, further comprising:

a second through hole formed in said head; and a second through channel communicating said second through hole to said third edge of said head.

7. The combination tool according to claim 6, wherein said first through hole has a first diameter, said second through hole has a second diameter, and said second diameter is greater than said first diameter.

8. The combination tool according to claim 6, further comprising:

a third through hole formed in said head;

a third through channel communicating said third through hole to said third edge of said head;

a fourth through hole formed in said head; and a fourth through channel communicating said fourth through hole to said third edge of said head.

9. The combination tool according to claim 8, wherein said first through hole has a first diameter, said second through hole has a second diameter, said third through hole has a third diameter, said fourth through hole has a fourth diameter, and said fourth diameter is greater than said third diameter which is greater than said second diameter which is greater than said first diameter.

10. The combination tool according to claim 5, wherein said third edge of said head is perpendicularly oriented with respect to said first edge of said elongate handle.

11. A combination tool comprising:

an elongate handle having a first end and a second end, said elongate handle being planar and lying in a first plane;

a head fixedly attached to said second end of said elongate handle, said head being planar and lying in said first plane;

a first through hole form in said head;

a first through channel communicating said first through hole to an edge of said head; and a first collar partially surrounding said first through hole and extending away from said head and said first plane to assist in holding a nail in said first through hole.

12. The combination tool according to claim 11, wherein said first collar has a first thickness, and wherein said first collar has second thicknesses, which are each less than said first thickness, adjacent perimeter portions of said first through hole adjacent said first through channel.

13. The combination tool according to claim 11, wherein said elongate handle and said head are constructed of a plastic material and are integrally formed.

14. The combination tool according to claim 11, wherein said elongate handle has a first edge, said head has a second edge and a third edge, said second edge abuts said first edge and forms a ninety degree angle with said first edge, and said first through channel communicates said first through hole to said third edge of said head.

15. The combination tool according to claim 14, wherein said third edge of said head is perpendicularly oriented with respect to said first edge of said elongate handle, and elongate handle and said head are constructed of a plastic material and are integrally formed.

16. The combination tool according to claim 14, wherein said third edge of said head is perpendicularly oriented with respect to said first edge of said elongate handle.

17. The combination tool according to claim 11, wherein said elongate handle has a straight, first edge including measurement markings.

18. The combination tool according to claim 17, wherein said elongate handle and said head are constructed of a plastic material and are integrally formed.

19. The combination tool according to claim 17, wherein said measurement markings include inch markings and a distance from said first end of said elongate handle to said first through hole of said head is approximately sixteen inches.

20. A combination tool comprising:

an elongate handle having a first edge and a first end and a second end;

a head attached to said second end of said elongate handle, said head having a second edge and a third edge, said second edge abutting said first edge and forming a ninety degree angle with said first edge;

a first through hole form in said head;

a first through channel communicating said first through hole to said third edge of said head; and a first collar partially surrounding said first through hole and extending away from an outer surface of said head, wherein said first collar has a first thickness adjacent a perimeter portion of said first through hole which is most remote from said third edge of said head, and wherein said first collar has second thicknesses, which are each less than said first thickness, adjacent perimeter portions of said first through hole adjacent said first through channel.

* * * * *